United States Patent [19]

Holtz

[11] 3,957,242

[45] May 18, 1976

[54] ROTATABLE HANGING DEVICE

[75] Inventor: Leonard Holtz, Oceanside, N.Y.

[73] Assignee: Turn-Up, Inc., Oceanside, N.Y.

[22] Filed: July 25, 1974

[21] Appl. No.: 491,819

[52] U.S. Cl. ..... 248/318

[51] Int. Cl.[2] ..... F16M 13/00

[58] Field of Search ..... 248/317, 318, 324, 339, 248/341, 342, 343

[56] References Cited

UNITED STATES PATENTS

| | | | |
|---|---|---|---|
| 649,270 | 5/1900 | Collins | 248/62 X |
| 812,691 | 2/1906 | Smith | 248/339 |
| 815,019 | 3/1906 | Kampfe | 248/339 |
| 841,945 | 1/1907 | Doughty | 248/339 |
| 851,505 | 4/1907 | Ernst | 248/62 X |
| 1,247,500 | 11/1917 | Bulmer | 248/339 |
| 1,548,128 | 8/1925 | Fisher | 248/304 |
| 1,796,428 | 3/1931 | Austin | 248/58 X |
| 1,966,899 | 7/1934 | McCabe | 248/62 |
| 2,643,079 | 6/1953 | Pitt | 248/62 |
| 2,854,824 | 11/1958 | Curry et al. | 248/339 X |
| 2,862,368 | 12/1958 | Dempsey | 248/339 X |
| 3,039,727 | 6/1962 | Engel | 248/245 |
| 3,167,286 | 1/1965 | Sherburne | 248/62 |

FOREIGN PATENTS OR APPLICATIONS

| | | | |
|---|---|---|---|
| 637,681 | 5/1950 | United Kingdom | 248/342 |

*Primary Examiner*—William H. Schultz
*Attorney, Agent, or Firm*—Flynn & Frishauf

[57] ABSTRACT

A rotatable hanging device comprises a main member having a substantially central bore therethrough which is adapted to receive a screw, or the like, for rotatably mounting same to a horizontal surface, such as a ceiling. An elongated suspension or hooked member extends downwardly from the main member. Preferably, the main member has additional bores therethrough on either side of the central bore and a recess in the upper surface thereof and in which the additional bores open. Preferably, the suspension or hooked member is of wire-like material, the ends of which extend through the additional bores and which are bent over or otherwise deformed so as to prevent their passing out again through said additional bores. Alternatively, the main member and suspension or hooked member are integrally formed.

24 Claims, 6 Drawing Figures

ROTATABLE HANGING DEVICE

BACKGROUND OF THE INVENTION

This invention relates to hanging devices, and more particularly to a rotatable hanging device.

Hanging devices for hanging an object from a substantially horizontal surface such as a ceiling or the like are known. However, in many instances, it is desired to hang an object from a ceiling while also allowing the object to be rotatable. This is particularly important when hanging plant baskets from the ceiling so that the plant can be rotated in order to successively expose the complete circumference of the plant to a light, for example, light coming in from a window.

The object of the present invention is to provide a rotatable hanging device which is attractive, simple in construction, inexpensive to manufacture and easy to use.

SUMMARY OF THE INVENTION

In accordance with the present invention, a rotatable hanging device comprises a main member having a substantially central bore therethrough and having at least one recess or depression in a first surface, the first surface being substantially perpendicular to the longitudinal axis of the bore. Further provided is at least one additional bore extending through the main member and terminating in the at least one recess or depression. An elongated suspension or hook member has at least one end which extends through the at least one additional bore, the extending end being deformed so as to be retained in the at least one additional bore, the at least one deformed end being received in the recess or depression.

According to another aspect of the invention, a main member having a substantially central bore therethrough has a suspension or hook member depending therefrom. The member is suspended through the central bore for rotation and the suspension or hook member receives an object to be hung.

DETAILED DESCRIPTION OF PREFERRED EMBODIMENTS

Figure 1:
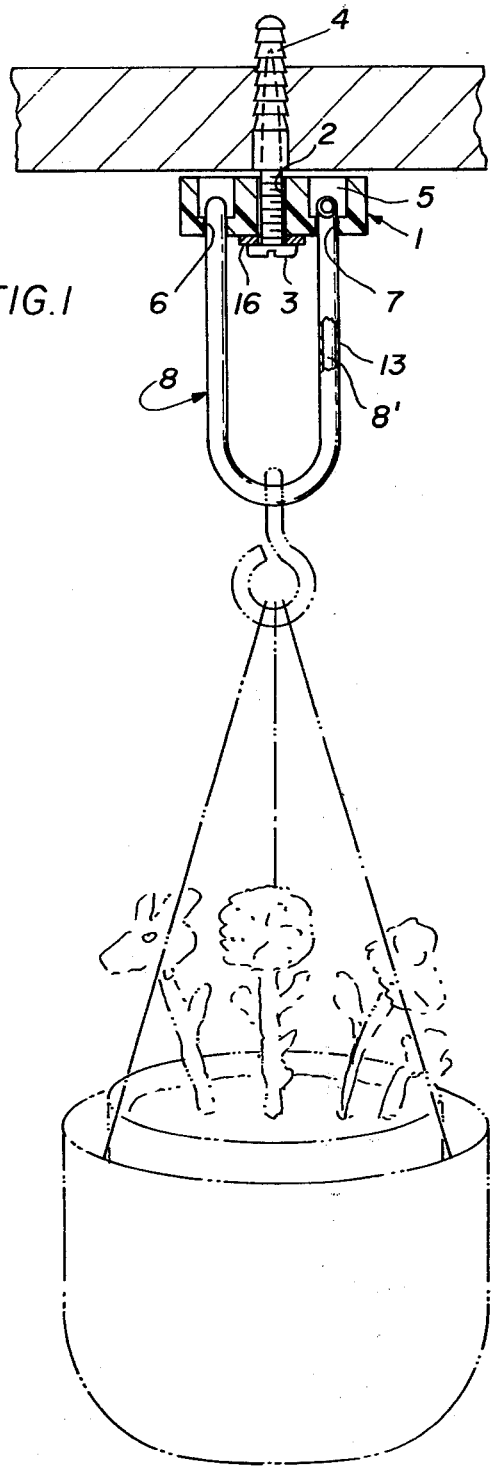
FIG. 1 is a cross-sectional view of the device of the present invention installed in a ceiling.
Figure 2:
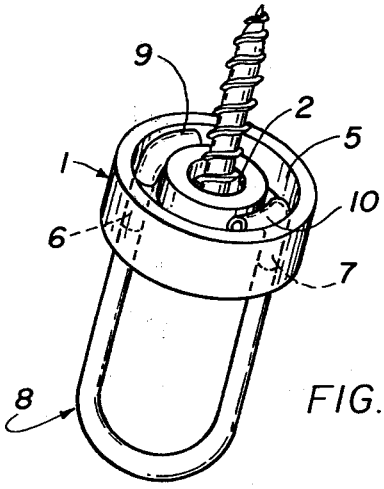
FIG. 2 is a rear perspective view of one preferred embodiment of the present invention.

Referring to FIGS. 1 and 2, a preferred embodiment of the present invention includes a main substantially diskshaped main member 1 having a central bore 2 therein. A screw 3 extends through the central bore for fastening the hanging device to a substantially horizontal surface, such as a ceiling, overhang, or the like as illustrated in FIG. 1. A washer 16 may be provided as shown in FIG. 1 to provide a larger bearing surface for the screw 3. In cases where the ceiling is plaster or plasterboard, toggle bolts, mollies or plastic anchoring devices (such as the anchoring device 4 illustrated in FIG. 1) may be used to provide secure support.

The main substantially disk-shaped member 1 has a circular recess, groove or depression 5 therein and two bores 6 and 7 which are substantially parallel to bore 2 which open into the groove or recess 5. A suspension member 8, preferrably of wire, is generally U-shaped and the ends thereof extend through bores 6 and 7. After insertion into bores 6 and 7, the ends 9 and 10 of wire 8 are preferrably bent over as shown, for example, in FIG. 2 to retain the suspension member 8 attached to member 1. The bent over portions 9 and 10 are accommodated in the depression or recess 5 so that the upper surface of the hanging device that confronts the ceiling is substantially smooth, thereby preventing damage to the ceiling and facilitating rotation of the member 1 about screw 3. The smooth surface also allows the screw 3 to retain the member 1 very close to the ceiling surface, thereby improving the appearance of the device. Preferably, the ends 9 and 10 are bent over in opposite directions as is clearly seen in FIG. 2 in order to balance the loading. The recess 5 need not be circular nor unitary. Two recesses for receiving respective bent over ends 9 and 10 could be provided.

Figure 3:
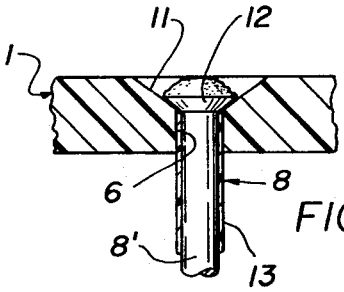
FIG. 3 is a partial sectional view of a modified embodiment of the present invention.

Referring to FIG. 3, instead of bending the ends 9 and 10 of the suspension member 8 as shown in FIG. 2, the ends of suspension member 8 may be flattened by impacting the same, or by other methods, in order to form an enlarged end portion 12 to prevent same from passing through the bores 6 and 7 during loading of the hanging device. In this instance, the substantially disk-shaped member 1 may have the groove or recess 5 of FIG. 2 or individual depressions 11 for accommodating the flattened portions 12 as illustrated in FIG. 3. In FIG. 3, only one end of suspension member 8 is shown. The other end is likewise formed.

As illustrated in FIGS. 1 and 3, the suspension member 8 is preferably of wire 8 and has a plastic covering 13 thereover. This improves appearance and is durable during fabrication of the device. Also, the plastic covering 13 is more durable in use than, for example, paint.

Figure 4:
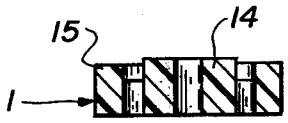
FIG. 4 is a partial sectional view of a further modification of the present invention.

FIG. 4 shows a modified form of the present invention wherein the central portion 14 of the member 1 is raised relative to the peripheral portion 15. This type of construction is useful where, for example, marks may possibly be made on the ceiling due to rotation. Since the outer portion 15 will never bear upon the ceiling, it will effectively hide any marks made by portion 14.

Figure 5:
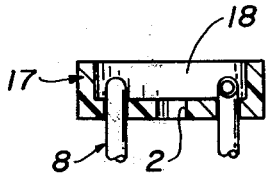
FIG. 5 is a partial sectional view of another embodiment of the invention.

FIG. 5 shows a modified form of the present invention wherein the main member 17 does not include a central portion such as portion 14 of FIG. 4, and wherein the recess is one continuous recess 18 in the central portion thereof. In some instances, this type of construction may be preferrable.

Figure 6:
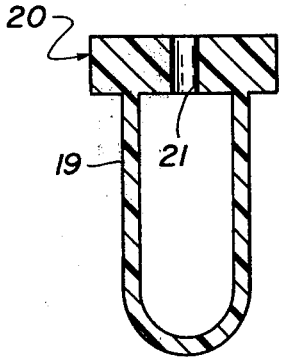
FIG. 6 is a sectional view of still another embodiment of the invention.

FIG. 6 shows still another modified form of the invention wherein the suspension member 19 is formed as an integral part of the main body member 20. Preferably, the members 19 and 20 are of plastic or the like material which has suitable strength, such as nylon, polyethylene, or the like. The portion 20 of FIG. 6 is molded with a bore 21 therein for receiving screw, such as screw 3 of FIG. 1 for suspending the hanging device from a ceiling, or the like.

The substantially disk-shaped member of FIGS. 1–5 is preferrably made of plastic, nylon, hard rubber or other suitable materials having appropriate structural strength and which have a low coefficient of friction so that they will easily rotate about the screw 3 without damaging the ceiling. Metal or wood may also be used, care being taken to insure that no sharp edges or protruding portions exist which could damage the mounting surface.

It should be clear that various other modifications to the present inventive concept may be made. For example, the sahpe of member 1 need not be disk-shaped. Member 1 may be eliptical, square or polygonal in shape. However, a circular shape as illustrated in the Figures is preferable since damage to the mounting surface will be minimized and any marks made in the mounting surface due to rotation thereof will always be covered. Further, member 1 may be modified to be substantially generally hemispherical in shape, with the circular portion thereof abutting against the mounting surface. Various other modifications may be made to the shape as is apparent.

While the suspension member 8 of FIGS. 1–5 is shown as being formed of a material such as wire, the suspension member 8 may also be formed of plastic, nylon or other suitable material and the ends thereof may be heat-deformed in order to retain same in the bores 6 and 7. The heatdeformation can be accomplished by heating and bending to result in a structure similar to that shown in FIG. 2, or the heat deformation may be performed to result in an enlarged end portion, such as end portion 12, shown in FIG. 3. Also, the suspension member 8 may take other shapes, for example, a hook, or may be of a flexible material.

If the suspension member 8 is flexible, it may be deformed at its ends by, for example, knotting. As used in the present specification and claims, the term "deformed" is used to include at least bent, flared, flattened, knotted, or any other such suitable means for preventing member 8 from falling through holes or bores 6 and 7.

While the invention is described as being hung from a ceiling, it may also be hung, for exmple, from an arm extending horizontally from a wall. In this event, depending upon the material of the arm, a screw and bolt may be used in place of screw 3 of FIG. 1.

During fabrication of the device, where the suspension member 8 is formed of a metal wire-type material, the bores 6 and 7 may be formed in the main member 1, which is formed of plastic, nylon or other heat deformable material, by heating the ends of the suspension member 8 and penetrating the member 1 by means of the heated ends, thereby simultaneously forming the bores 6 and 7.

While the invention has been described above with respect to specific embodiments, it should be clear that various other modifications and alterations may be made to the inventive concept within the scope of the appended claims.

I claim:

1. A rotatable hanging device comprising:

a main member having a substantially central bore therethrough and having at least one recess or depression in a first surface thereof, said first surface being substantially perpendicular to the longitudinal axis of said substantially central bore;

at least two additional bores extending through said main member and terminating in said at least one recess or depression;

an elongated suspension member having at least two interconnected legs, the legs having free ends which extend through respective ones of said at least two additional bores so as to define a closed loop with said main member, the free ends of said legs of said suspension member being deformed so as to be retained in said respective additional bores, the deformed ends being at least partially received in said at least one recess or depression; and stationary mounting means extending through said substantially central bore of said main member for rotatably mounting said main member to a substantially horizontal mounting surface, said main member being rotatable relative to said stationary mounting means.

2. The device according to claim 1 wherein said two additional bores are located substantially symmetrically about said substantially central bore on diametrically opposite sides of said substantially central bore, taken in a direction perpendicular to the axis of said substantially central bore.

3. The device according to claim 1 wherein said deformed ends are completely received in said at least one recess or depression.

4. The device according to claim 1 wherein said at least one recess or depression is an annular groove surrounding said substantially central bore and extending partially through the thickness of said member.

5. The device according to claim 1 wherein the ends free of said suspension member are bent over after being inserted in said additional bores.

6. The device according to claim 5 wherein said free ends are bent over in opposite directions.

7. The device according to claim 1 wherein said suspension member is generally U-shaped.

8. The device according to claim 1 wherein said suspension member is a wire-like member having a plastic outer covering thereon.

9. The device according to claim 1 wherein said mounting means includes a screw extending through said substantially central bore and being freely rotatable substantially central bore for rotatably mounting said member to a substantially horizontal surface.

10. The device according to claim 1 wherein free the ends of said suspension member are expanded after being inserted in said additional bores.

11. The device according to claim 10 including two of said recesses or depressions, each free end of said suspension member being received in a respective recess or depression.

12. The device according to claim 1 including two of said recesses or depressions, each free end of said suspension member being received in a respective recess or depression.

13. The device according to claim 1 wherein said main member is generally disc-shaped and has a central portion which is thicker than the peripheral portion thereof.

14. A rotatable hanging device adapted to be mounted to a fixed, substantially horizontal mounting surface, comprising:

a main member having a substantially central bore therethrough and having a first bearing surface which is substantially perpendicular to the longitudinal axis of said substantially central bore, said first bearing surface facing said substantially horizontal mounting surface;

an elongated, flexible suspension means having at least two interconnected legs non-removably secured to and depending from said main member substantially symmetrically about said substantially central bore and defining in combination with said main member an integral closed loop, said suspension means passing through an extension of the longitudinal axis of said substantially central bore and being resiliently deflectable at least partially out of the path of said extension of said longitudinal axis, said suspension means further being non-rotatable relative to said main member and being adapted to receive and support an object to be hung; and stationary mounting means extending through said substantially central bore of said main member for rotatably mounting said main member to said substantially horizontal mounting surface with said first bearing surface adjacent said substantially horizontal mounting surface, said main member being rotatable relative to said stationary mounting means.

15. A rotatable hanging device according to claim 14 wherein said main member has a second surface opposite said first bearing surface, said elongated, flexible suspension means integrally depending from said second surface; and wherein said stationary mounting means includes an elongated portion extending through said substantially central bore with clearance therebetween, and an enlarged portion at an end of said elongated portion, said enlarged portion being non-passable through said substantially central bore and slidably bearing against said second surface.

16. A rotatable hanging device according to claim 14 wherein said main member has a substantially central boss about said substantially central bore, said boss having a bearing surface which is in substantially the same plane as said first bearing surface.

17. A rotatable hanging device according to claim 16 wherein said main member and suspension means are integrally made of plastic material and wherein first bearing surface comprises a substantially flat surface located about the periphery of said main member and spaced from said substantially central bore, with a depression therebetween.

18. A rotatable hanging device according to claim 14 wherein said mounting means comprises a headed screw which extends through said substantially central bore and which non-rotatably engages said mounting surface, the head of said screw being impassable through said substantially central bore.

19. A rotatable hanging device according to claim 18 further comprising anchor means tightly and non-rotatably engageable with said screw, said anchor means being adapted to be non-rotatably mounted into said mounting surface.

20. A rotatable hanging device according to claim 14 wherein said member is substantially disc-shaped.

21. A rotatable hanging device according to claim 14 wherein said member has a substantially circular periphery in the vicinity of said first bearing surface.

22. A rotatable hanging device according to claim 14 wherein said main member has a second surface opposite said first bearing surface, and said elongated flexible suspension means comprises a one-piece, generally U-shaped suspension means integrally depending from said second surface, said main member and suspension means being comprised of plastic material.

23. A rotatable hanging device according to claim 14 wherein said elongated flexible suspension means is a one-piece, generally U-shaped, member having two integrally interconnected legs, each of which has a free end, the free ends of said interconnected legs integrally depending from said main member on diametrically opposite sides of said substantially central bore, taken in a direction perpendicular to the axis of said substantially central bore, whereby said suspension means is substantially symmetrically oriented about said substantially central bore.

24. A rotatable hanging device according to claim 14 wherein said suspension means is non-rotatable relative to said main member about the longitudinal axis of said substantially central bore.

* * * * *

UNITED STATES PATENT AND TRADEMARK OFFICE

CERTIFICATE OF CORRECTION

PATENT NO. : 3,957,242

DATED : May 18, 1976

INVENTOR(S) : Leonard HOLTZ

It is certified that error appears in the above-identified patent and that said Letters Patent are hereby corrected as shown below:

Column 4 (claim 5), lines 27 and 28, change "ends free" to --free ends--;

(claim 9), line 40, before "substantially" insert --in said--;

(claim 10), line 42, change "free the" to --the free--.

Signed and Sealed this

Twentieth Day of July 1976

[SEAL]

*Attest:*

RUTH C. MASON
*Attesting Officer*

C. MARSHALL DANN
*Commissioner of Patents and Trademarks*